US010321729B2

(12) United States Patent
Aguilera Robles et al.

(10) Patent No.: US 10,321,729 B2
(45) Date of Patent: Jun. 18, 2019

(54) HELMET AND METHOD FOR MANUFACTURING THEREOF

(71) Applicant: Tespack Oy, Helsinki (FI)

(72) Inventors: Mario Luis Aguilera Robles, Helsinki (FI); Sami Petteri Pfaler, Helsinki (FI); Matti Naskali, Valencia (ES); Victor Alós Monzó, Valencia (ES)

(73) Assignee: Tespack Oy, Helsinki (FI)

( * ) Notice: Subject to any disclaimer, the term of this patent is extended or adjusted under 35 U.S.C. 154(b) by 71 days.

(21) Appl. No.: 15/471,459

(22) Filed: Mar. 28, 2017

(65) Prior Publication Data

US 2017/0360139 A1 Dec. 21, 2017

(30) Foreign Application Priority Data

Jun. 17, 2016 (FI) ..... 20165503

(51) Int. Cl.

| | |
|---|---|
| ***A42B 3/04*** | (2006.01) |
| ***A42B 3/06*** | (2006.01) |
| ***A42C 2/00*** | (2006.01) |

(52) U.S. Cl.

CPC ..... *A42B 3/068* (2013.01); *A42B 3/04* (2013.01); *A42B 3/0406* (2013.01); *A42B 3/063* (2013.01); *A42C 2/00* (2013.01)

(58) Field of Classification Search

CPC ..... A42B 3/0406; A42B 3/10; A42B 3/00
See application file for complete search history.

(56) References Cited

U.S. PATENT DOCUMENTS

| | | | | |
|---|---|---|---|---|
| 5,176,342 | A * | 1/1993 | Schmidt | A42B 3/042 2/422 |
| 5,623,730 | A * | 4/1997 | Baudou | A42B 3/04 2/6.2 |
| 6,014,769 | A | 1/2000 | Baudou | |
| 7,004,439 | B1 | 2/2006 | Taylor et al. | |
| 9,032,557 | B2 * | 5/2015 | Bryant | A42B 3/08 2/410 |
| 2015/0286117 | A1 | 10/2015 | Sung et al. | |
| 2016/0037854 | A1 | 2/2016 | Durham et al. | |

FOREIGN PATENT DOCUMENTS

| | | |
|---|---|---|
| EP | 0861607 A1 | 9/1998 |
| EP | 2949229 A2 | 12/2015 |
| GB | 2424821 A | 10/2006 |

OTHER PUBLICATIONS

Search report of the Finnish Patent Application No. 20165503 dated Jan. 9, 2017, Finnish Patent and Registration Office.
European Search Report issued in the EP patent application No. 17163507.1, reported on Sep. 20, 2017.

* cited by examiner

*Primary Examiner* — Tajash D Patel
(74) *Attorney, Agent, or Firm* — Berggren LLP

(57) ABSTRACT

A helmet comprising a first protective layer, the first protective layer comprising at least one accessory mount portion for receiving an accessory mount or an accessory, the at least one accessory mount portion being arranged integrally as a part of the first protective layer and configured to disintegrate from the rest of the first protective layer in response to a mechanical impact to the at least one accessory mount portion for preventing the accessory mount portion and/or the accessory from penetrating through the helmet.

12 Claims, 5 Drawing Sheets

HELMET AND METHOD FOR MANUFACTURING THEREOF

PRIORITY

This application claims priority of Finnish application number FI 20165503, filed on Jun. 17, 2016, and the contents of which is incorporated herein by reference.

TECHNICAL FIELD

The invention concerns in general the technical field of helmets. Especially the invention concerns systems for the safety of helmets, such as motorcycle, motocross, snowmobile, ski, snowboard, skateboard helmets, etc., with attached accessories.

BACKGROUND

Attaching accessories to a helmet can yield the helmet unsafe to wear. For example, a camera attached to a helmet may penetrate through the helmet and cause significant damage to the user. The helmet can become also dangerous if the accessory is mounted rigidly so that in an event of an impact to the accessory, the impact will cause tangential force or torque to user's head and can thus cause severe damages.

Some attempted solutions exist which utilize mounting platforms, base or rails attached to the surface of the helmet on which the accessory such as camera has been attached. These solutions can make the use of camera more comfortable but doesn't prevent the accessory to cause danger.

Some attempts utilize magnets for attaching the accessories to the helmet. While the accessory can detach from the magnet quite easily in case of an impact, the magnet itself is still rigidly attached to the helmet and can become dangerous.

There is still need for a helmet to which accessories can be attached without jeopardizing the safety of the helmet.

SUMMARY

An objective of the invention is to present a helmet and a method for producing a helmet. Another objective of the invention is that the helmets and the method for producing the helmets provide safety for the user attaching accessories to the helmet.

The objectives of the invention are reached by helmets and a method as defined by the respective independent claims.

According to a first aspect of the present invention, a helmet comprising a first protective layer is provided. The first protective layer comprises at least one accessory mount portion for receiving an accessory mount. The at least one accessory mount portion is being arranged integrally as a part of the first protective layer and configured to disintegrate from the rest of the first protective layer in response to a mechanical impact to the at least one accessory mount portion.

The accessory mount portion may comprise an accessory mount base for receiving the accessory mount or an accessory.

The accessory mount portion may comprise an inner surface and an outer surface. The inner surface may face an inside volume of the helmet and the outer surface may face outer side of the helmet. The outer surface may face an opposite direction with respect to the inner surface, and wherein the outer surface is larger than the inner surface.

The helmet may further comprise at least one protective element arranged substantially in a corresponding position relative to the at least one accessory mount portion for preventing the at least one accessory mount portion from penetrating through the helmet. Said protective element may, preferably, be arranged directly under the at least one accessory mount portion, 'under' referring herein to a position between the at least one accessory mount portion and the user's head when the helmet is used in a normal manner for protecting the user's head. There may further be a second protective layer arranged between said protective element and the user's head.

The helmet may comprise a volume between the at least one accessory mount portion and the corresponding protective element to provide space for the at least one accessory mount portion to move in response to the mechanical impact to the at least one accessory mount portion.

The at least one accessory mount portion may consist of material withstanding without breaking a lower mechanical impact to the at least one accessory mount portion with respect to the material of the first protective layer.

The first protective layer may comprise at least one weakening portion configured to break in response to the mechanical impact to the at least one accessory mount portion for disintegrating the at least one accessory mount portion from the rest of the first protective layer.

The at least one weakening portion may consist of material withstanding without breaking a lower mechanical impact to the at least one accessory mount portion with respect to the material of the first protective layer.

The at least one weakening portion may comprise a groove configured to break in response to the mechanical impact to the at least one accessory mount portion for disintegrating the at least one accessory mount portion from the rest of the first protective layer.

The at least one weakening portion may comprise a perforation configured to break in response to the mechanical impact to the at least one accessory mount portion for disintegrating the at least one accessory mount portion from the rest of the first protective layer.

The at least one weakening portion may comprise a plurality of holes. At least one of the plurality of holes may have a depth in the direction of the thickness of the first protective layer less than the thickness of the first protective layer. The plurality of holes may be configured to break in response to the mechanical impact to the at least one accessory mount portion for disintegrating the at least one accessory mount portion from the rest of the first protective layer.

The at least one weakening portion may be arranged around the at least one accessory mount portion defining a portion of the first protective layer with an unsymmetrical shape for disintegrating the at least one accessory mount portion in response to a lower mechanical impact from a first direction with respect to a mechanical impact from a second direction perpendicular to the first direction.

According to a second aspect of the present invention, a method for manufacturing a helmet is provided. The method comprises obtaining a first protective layer, and arranging at least one accessory mount portion integrally to the first protective layer by molding, such as by injection plastic molding, at least one weakening portion to the first protective layer. The at least one weakening portion may be configured to disintegrate the at least one accessory mount portion from the rest of the first protective layer in response to a mechanical impact to the at least one accessory mount.

The helmet according to the present invention provides safety for the user wearing accessories attached to helmet. Especially the helmet provides safety against the hard accessories, typically having sharp edges, attached to outer surface of the helmet and residing outside of the helmet. The helmet according the present invention comprises at least one accessory mount portion which disintegrates from the helmet rather than penetrates through the helmet in case of a mechanical impact to the accessory mount portion or the accessory itself.

The expression "a number of" refers herein to any positive integer starting from one, e.g. to one, two, or three.

The expression "a plurality of" refers herein to any positive integer starting from two, e.g. to two, three, or four.

The terms "first" and "second" do not denote any order, quantity, or importance, but rather are used to distinguish one element from another.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1:
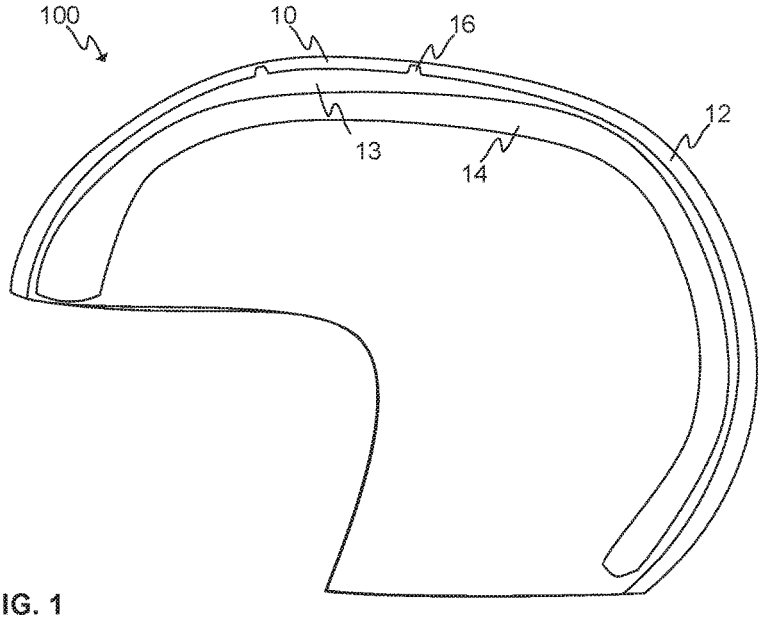
FIG. 1 illustrates schematically a helmet comprising an accessory mount portion according to an embodiment of the present invention.

FIG. 1 illustrates schematically a helmet according to an embodiment of the present invention. The helmet 100 comprises a first protective layer 12. The first protective layer 12 is typically the outermost layer of the helmet 100 and is adapted to receive a mechanical impact in cases, for example, where the user falls and hits his head to the ground. The main task of the first protective layer 12 is to cover the user's head from direct impacts and to distribute the energy of the impact to larger surface than the contact surface of the object causing the impact. The first protective layer 12 may be, for example, from 0.1 to 0.5 centimeters or from 0.2 to 1.5 centimeters in thickness.

According to some embodiments of the present invention, the first protective layer 12 may comprise thermoplastic material enabling molding, such as injection plastic molding, techniques to be utilized. The first protective layer 12 may comprise acrylonitrile butadiene styrene (ABS), polycarbonate, glass, paraaramid synthetic fibers, such as Kevlar®, and carbon fiber composite, or thermosetting polymers. According to various embodiments, these materials alone or, e.g., in addition to metals and/or pieces of metals can be used for the accessory mount portion 10 as well. According to an embodiment of the present invention, the first protective layer 12 may comprise material based on paper pulp or other biodegradable materials, such as wood, paper laminates or pulp pressed, or solid wood.

According to an embodiment of the present invention, the first protective layer 12 may comprise at least one accessory mount portion 10 to which an accessory mount, such as of a camera or flashlight, may be arranged. The at least one accessory mount portion 10 may be integrally arranged as a part of the first protective layer 12. The helmet may, preferably, also comprise an inner protective layer 14, which typically is soft and able to absorb at least part of the energy of the impact.

According to an embodiment of the present invention, one accessory mount or one accessory may be arranged to several accessory mount portions 10 such that, e.g., one of several supports of the accessory mount or the accessory resides to one accessory mount portion 10.

According to an embodiment of the present invention, the at least one accessory mount portion 10 may comprise titanium, aluminum, and/or carbon fiber. The strength of the at least one accessory mount portion may be affected by altering the thickness of the at least one accessory mount portion 10. According to an embodiment, the at least one accessory mount portion 10 may be thermoplastic which may be strengthened with fibers, e.g. glass fibers.

According to an embodiment of the present invention, the at least one accessory mount portion 10 may have a shape such as round, oval, ellipse, square, rectangular or any other shape. According to an embodiment of the present invention, the diameter, or an average diameter, of the at least one accessory mount portion 10 may be, for example, less than 3.0, 5.0 or 7.0 centimeters.

There may, according to various embodiments of the present invention, also be a second protective layer 13 arranged between the first protective layer 12 and the inner protective layer 14. The second protective layer 13 may be deformable and thus capable of significantly absorb the energy of the impact by deformation. The second protective layer 13 may comprise, for example, polystyrene or polypropylene. The second protective layer 13, if any, may be, for example, from 1.0 to 2.0 or from 1.5 to 5.0 centimeters in thickness.

According to an embodiment of the present invention, the helmet 100 may comprise at least one weakening portion 16 which is configured to break in response to a mechanical impact to the at least one accessory mount portion 10 for disintegrating the at least one accessory mount portion 10 from the rest of the first protective layer 12.

According to various embodiments of the present invention, the mechanical impact to the at least one accessory mount portion 10 may be a direct mechanical impact. It may also be an indirect mechanical impact through an accessory mount base 30, an accessory mount or an accessory 50, or in many cases through several of the three mentioned elements to the at least one accessory mount portion 10.

According to various embodiments of the present invention, the at least one accessory mount portion 10 may be adapted to have larger outer surface than the inner surface. The outer surface refers herein to the surface facing the surroundings of the helmet and on which side the accessory, when mounted, is disposed. In typical conditions, the outer surface receives the mechanical impact. The inner surface refers herein to the inside volume of the helmet, i.e. the surface facing the user's head when the helmet is being worn by a user in normal manner. The inner surface thus faces an opposite direction with respect to the outer surface. According to a preferable embodiment, the at least one accessory mount portion 10 has a shape of a truncated cone with larger surface on the outer surface of the helmet 100. The shape described herein prevents the at least one accessory mount portion from penetrating the helmet through the opening which is formed after disintegration of the at least one accessory mount portion 10 from the rest of the first protective layer 12.

According to an embodiment of the present invention, the at least one weakening portion 16 may comprise a thinner part, such as a groove, cause by shape of the mold, in case of utilizing molding techniques for producing the first protective layer 12. According to an embodiment of the present invention, the weakening portion 16 may be made by varying the thickness of the material used in the first protective layer 12, or by laser treatment, or by manufacturing the weakening portion 12 as a separate part which is then attached to the first protective layer 12. According to another embodiment of the present invention, mechanical engraving, heat treatment, or chemical etching may be used for producing the at least one weakening portion 16.

Figure 2:
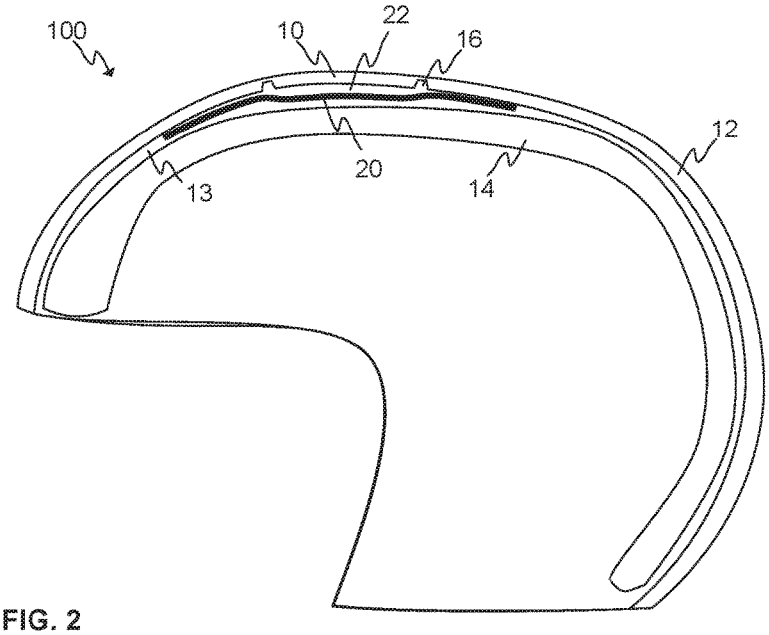
FIG. 2 illustrates schematically a helmet comprising an accessory mount portion and a protective element according to an embodiment of the present invention.

FIG. 2 illustrates schematically a helmet 100 according to an embodiment of the present invention. The helmet 100 may comprise at least one protective element 20 arranged to a corresponding position or positions relative to the at least one accessory mount portion 10. The purpose of the at least on protective element 20 is to prevent or at least try to prevent the at least one accessory mount portion 10 from penetrating the helmet 100 in case of a mechanical impact to the at least one accessory mount portion 10. Said protective element 20 may, preferably, be arranged directly under the at least one accessory mount portion 10, 'under' referring herein to a position between the at least one accessory mount portion and the user's head when the helmet is used in a normal manner for protecting the user's head such as shown in FIG. 2.

There may, preferably, be, as shown in FIG. 2, a space 22 arranged between the accessory mount portion 10 and the protective element 20. The space 22 will further facilitate the disintegration of the at least one accessory mount portion 10 in response to a mechanical impact to the said mount portion 10 by allowing said mount portion 10 to slightly move thus breaking and disintegrating from the rest of the first protective layer 12 more easily.

Figure 3:
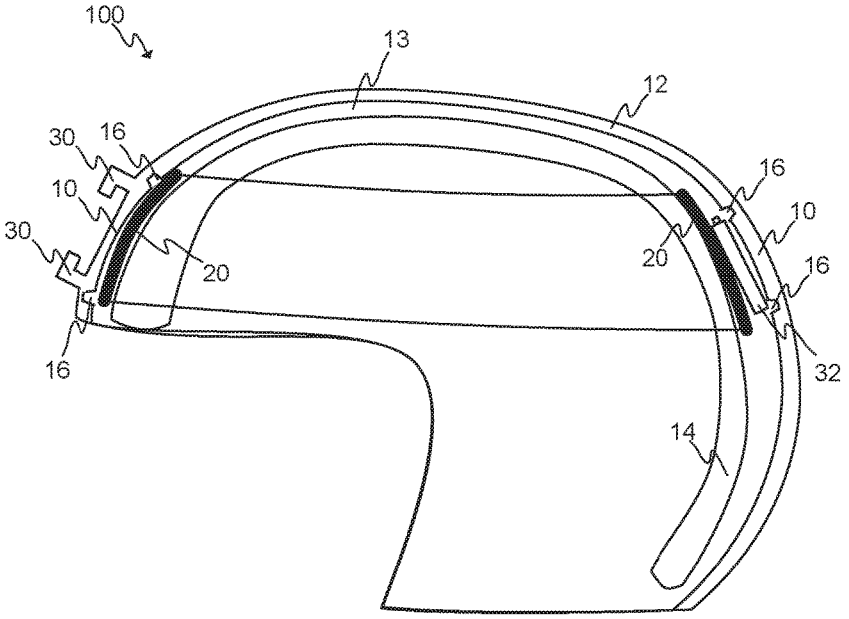
FIG. 3 illustrates schematically a helmet comprising two accessory mount portions and a protective element arranged in corresponding positions with respect to the two accessory mount portions according to an embodiment of the present invention.

FIG. 3 illustrates schematically a helmet 100 according to an embodiment of the present invention. The helmet 100 may comprise at least one protective element 20 arranged to corresponding positions relative to the at least one accessory mount portion 10, in this case, two accessory mount portions 10. The protective element 20 in this case is a band-type element but it may also be a plate- or disk-type. The protective element 20 may be straight or may have a convex or concave shape. The purpose of the at least on protective element 20 is to prevent or at least try to prevent the at least one accessory mount portion 10 from penetrating the helmet 100. According to the specific embodiment illustrated in FIG. 3, the at least one protective element 20 is a band which extends to prevent or at least to try to prevent either one or both of two accessory mount portions 10 from penetrating the helmet 100. The protective element 20 may also cover the user's head from objects 32, such as an electronics component or for example a magnet, arranged between the first protective layer 12 and the protective element 20.

Figure 4:
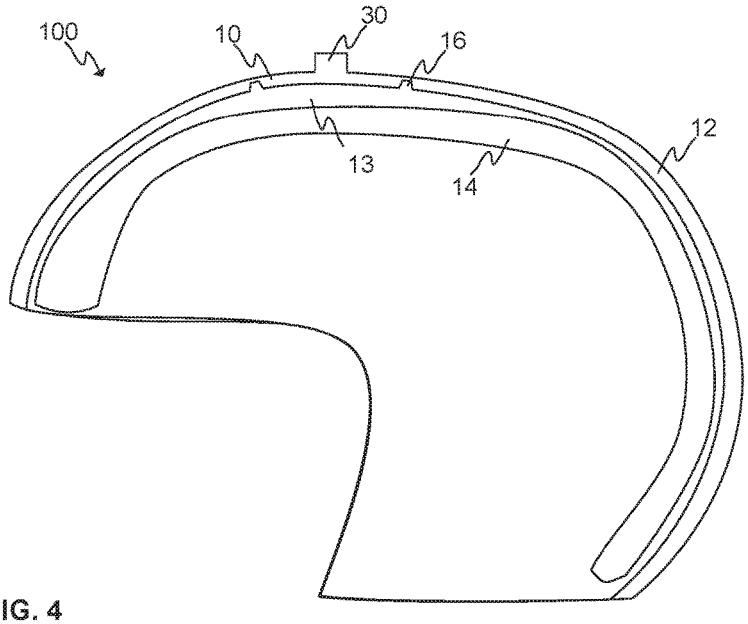
FIG. 4 illustrates schematically a helmet comprising an accessory mount portion and an accessory mount base according to an embodiment of the present invention.

According to an embodiment of the present invention, the helmet 100 may comprise an accessory mount base 30 as shown in FIGS. 3 and 4. The accessory mount base 30 may be utilized to attach an accessory mount or directly an accessory, such as a camera 50. The accessory mount base 30 may be a general type of mounting base or a specific mounting base for a specific type of accessory 50. According to an embodiment of the present invention, the accessory mount base 30 may be an integral part of the at least one accessory mount portion 10. According to another embodiment of the present invention, the accessory mount base may be attached removable to the least one accessory mount portion 10. According to an embodiment of the present invention, the accessory mount base 30 may be, e.g., a screw, bolt or pin. According to an embodiment of the present invention, the accessory mount base 30 may comprise a screw thread, a bayonet mount, a slide and click-mount, bend and click-mount, double-sided tape, or a rail/rails.

Figure 5:
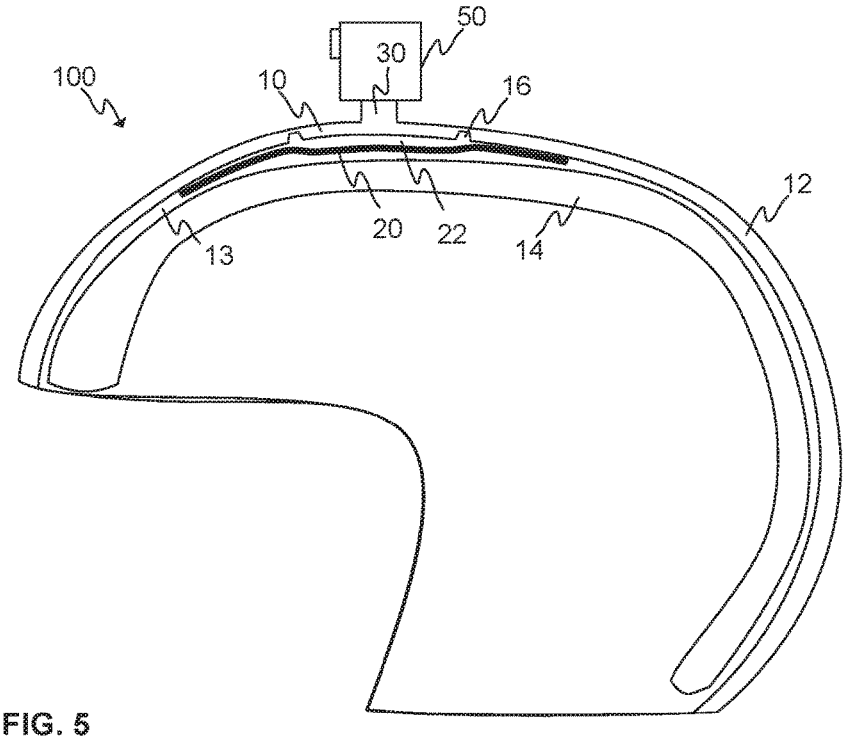
FIG. 5 illustrates schematically a helmet comprising an accessory mount portion and an accessory mount base or an accessory mount to which an accessory, in this example a camera, has been mounted according to an embodiment of the present invention.

FIG. 5 illustrates schematically a helmet 100 according to an embodiment of the present invention comprising an accessory mount portion 10, an accessory mount base 30 or an accessory mount, and a protective element 20 arranged in a corresponding position relative to the accessory mount portion 10.

Figure 6A:
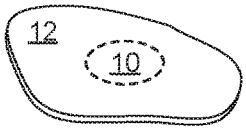
FIGS. 6A-6B illustrate cutaway and section views of an accessory mount portion according to an embodiment of the present invention consisting of a material withstanding without breaking a lower mechanical impact to the accessory mount portion with respect to the material of the first protective layer.
Figure 6B:
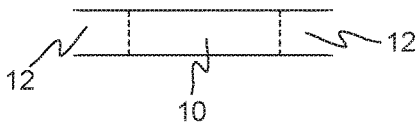

According to an embodiment of the present invention, in FIGS. 6A and 6B, the at least one accessory mount portion 10 may consist of same or different material than the first protective layer 12. FIGS. 6A and 6B, as well as FIGS. 7A-11B, illustrate embodiments of the present invention as cutaway and section views of the accessory mount portion 10 and/or the weakening portion 16. According to an embodiment of the present invention, the material of the at least one accessory mount portion 10 may be able to withstand without breaking a lower mechanical impact with respect to the material of the first protective layer 12. Thus by a choice of suitable materials, such as metal or ABS for the first protective layer 12 and thermoplastics, polyurethane or certain composites which withstand lower impact without breaking, for example, composites not having glass, carbon or Kevlar® fibers, for the at least one accessory mount portion 10, said accessory mount portion 10 may be configured to disintegrate from the rest of the first protective layer 12 in response to a mechanical impact to the accessory mount portion 10. Therefore the mechanical impact which the at least one accessory mount portion 10 withstands without breaking, and thus disintegrating from the rest of the first protective layer 12, may be configured to have a pre-determined level depending on the chosen material of the accessory mount portion 10.

Figure 7A:
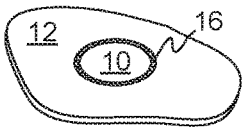
FIGS. 7A-7C illustrate cutaway and section views of at least one weakening portion comprising a groove according to an embodiment of the present invention.
Figure 7C:
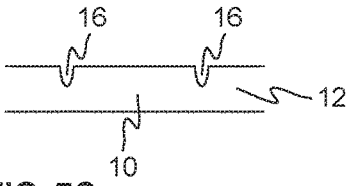
Figure 7B:
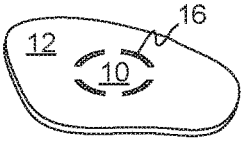

FIGS. 7A-7C illustrate, according to an embodiment of the present invention, the at least one weakening portion 16 that may comprise a groove. The groove may be arranged on the inner or the outer surface of the first protective layer 12.

According to an embodiment of the present invention, the at least one weakening portion 16 comprising one weakening element or several weakening elements arranged corresponding positions with respect to one accessory mount portion 10. This is illustrated in FIGS. 7A and 7B. In FIG. 7A, there is one weakening element comprising a groove, but could be a hole, perforation, piece of different material than the first protective layer 12, which surrounds the respective at least one accessory mount portion 10. In response to a mechanical impact to the at least one accessory mount portion 10, the accessory mount portion would disintegrate along the one weakening element 16. According to an embodiment of the present invention shown in FIG. 7B, the at least one weakening portion comprises several weakening elements 16, i.e., four grooves, surrounding the at least one accessory mount portion 10. FIG. 7C illustrate a cross section view of the at least one weakening portion taken essentially perpendicular with respect to the at least one accessory mount portion 10.

Figure 8A:
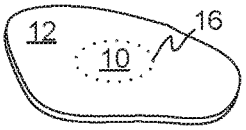
FIGS. 8A-8B illustrate cutaway and section views of at least one weakening portion comprising a perforation according to an embodiment of the present invention.
Figure 8B:
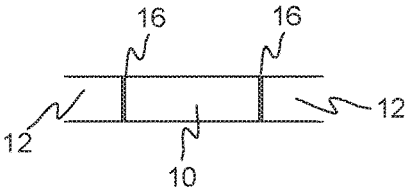

FIGS. 8A-8B illustrate, according to an embodiment of the present invention, the at least one weakening portion 16 comprising a perforation. The perforation 16 may be arranged to extend through the first protective layer 12. At least one of the plurality of holes 16 composing the perforation may extend through the first protective layer 12.

Figure 9A:
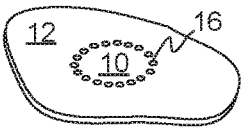
FIGS. 9A-9B illustrate cutaway and section views of at least one weakening portion comprising a plurality of holes according to an embodiment of the present invention.
Figure 9B:
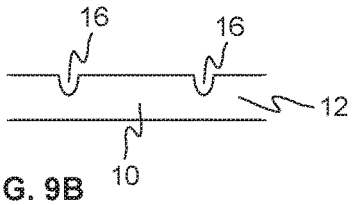

FIGS. 9A-9B illustrate, according to an embodiment of the present invention, the at least one weakening portion 16 comprises a plurality of holes 16. At least one of the plurality of holes 16 may have a depth in the direction of the thickness of the first protective layer 12 less than the thickness of the first protective layer 12. The at least one of the plurality of holes 16 may be arranged on the inner or the outer surface of the first protective layer 12.

Figure 10A:
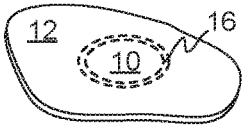
FIGS. 10A-10B illustrate cutaway and section views of at least one weakening portion comprising material withstanding without breaking a lower mechanical impact to the accessory mount portion with respect to the material of the first protective layer according to an embodiment of the present invention.
Figure 10B:
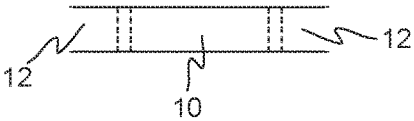

FIGS. 10A-10B illustrate, according to an embodiment of the present invention, the at least one weakening portion 16 consisting of a material withstanding without breaking a lower mechanical impact with respect to the material of the first protective layer 12. According to an embodiment, the at least one weakening portion 16 may consist of the same or a different material than the at least one accessory mount portion 10. The at least one weakening portion 16 may comprise material such as polyurethane, composites with different characteristics, such as durability or strength, than material of the first protective layer 12 or the accessory mount portion 10, e.g. a composite not having glass, carbon, or Kevlar fibers at the weakening portion 16. According to an embodiment of the present invention, the at least one weakening portion 16 may comprise elastomers.

Figure 11A:
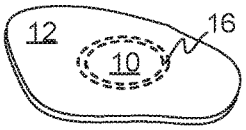
FIGS. 11A-11B illustrate cutaway and views of at least one weakening portion comprising at least one hole or groove having a depth in the direction of the thickness of the first protective layer less than the thickness of the first protective layer according to an embodiment of the present invention.
Figure 11B:
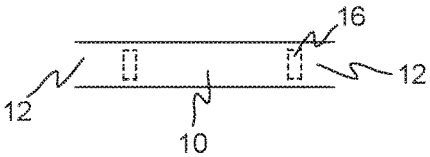

FIGS. 11A-11B illustrate, according to an embodiment of the present invention, the at least one weakening portion 16, such as a groove, a hole, or piece of the at least weakening portion consisting of a material withstanding without breaking a lower mechanical impact with respect to the material of the first protective layer 12, is arranged such that the at least one weakening portion 16 may be arranged extend through the first protective layer or to have a width in the direction of the thickness of the first protective layer less than the thickness of the first protective layer 12. The at least one weakening portion 16 may be arranged closer to the inner than the outer surface of the first protective layer 12, or vice versa.

Figure 12:
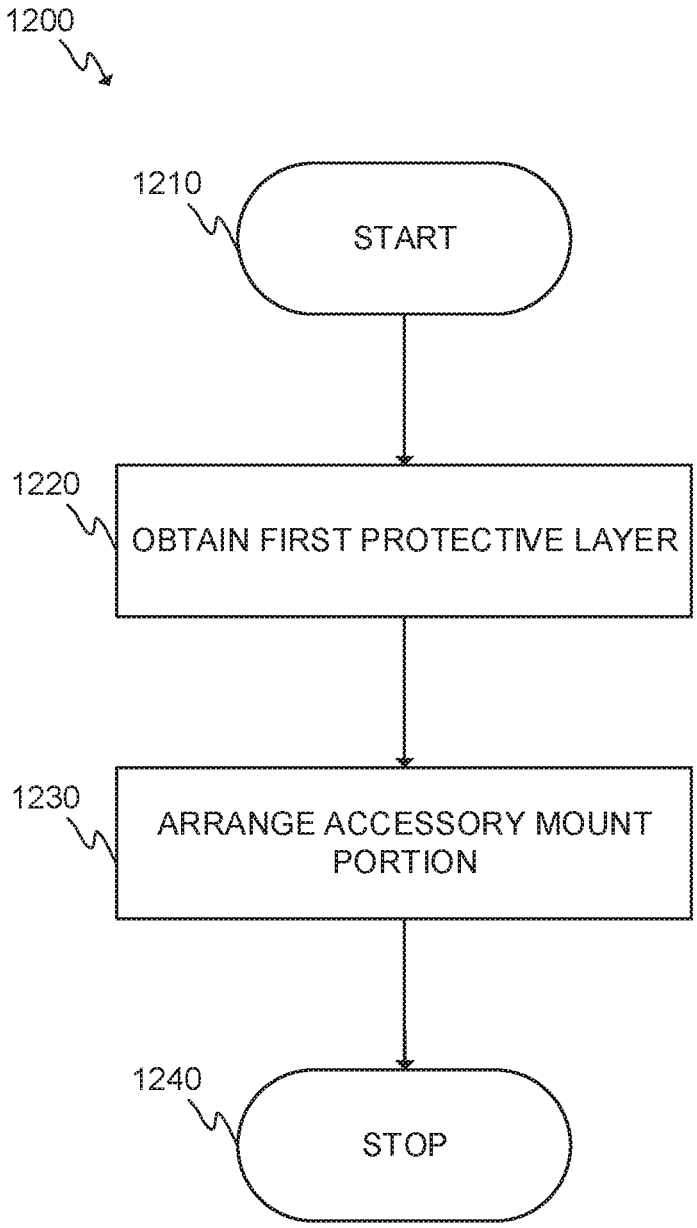
FIG. 12 illustrates a flow diagram of the method according to the present invention.

FIG. 12 illustrates, at 1200, a flow diagram of a method for manufacturing a helmet according an embodiment of the present invention.

Item 1210 refers to a start-up phase of the method. Suitable materials, systems and machinery are obtained for manufacturing a helmet.

At 1220, a first protective layer 12 in being obtained. A suitably formed or shaped layer may be obtained or the first protective layer may be done by, for example, molding thermoplastic material to a suitable form.

At 1230, at least one accessory mount portion is being integrally arranged to the first protective layer. The at least one accessory mount portion is configured to disintegrate from the rest of the first protective layer in response to a mechanical impact to the at least one accessory mount. The at least one accessory mount portion may be same or different material than the first protective layer. The method step 1230 may be performed substantially simultaneously with the step 1220 if, for example, molding, such as injection plastic molding, techniques are used.

Method execution is ended at 1240 at which the helmet 100 comprising at least one accessory mount portion has been manufactured.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A helmet comprising a first protective layer, the first protective layer comprising at least one accessory mount portion for receiving an accessory mount, the at least one accessory mount portion being arranged integrally as a part of the first protective layer and configured to disintegrate from the rest of the first protective layer in response to a mechanical impact to the at least one accessory mount portion, wherein the first protective layer comprises at least one weakening portion configured to break in response to the mechanical impact to the at least one accessory mount portion for disintegrating the at least one accessory mount portion from the rest of the first protective layer, and wherein the at least one weakening portion comprises one of the following:

a groove configured to break in response to the mechanical impact to the at least one accessory mount portion for disintegrating the at least one accessory mount portion from the rest of the first protective layer, or a perforation configured to break in response to the mechanical impact to the at least one accessory mount portion for disintegrating the at least one accessory mount portion from the rest of the first protective layer, or a plurality of holes, at least one of the plurality of holes having a depth in the direction of the thickness of the first protective layer less than the thickness of the first protective layer, the plurality of holes configured to break in response to the mechanical impact to the at least one accessory mount portion for disintegrating the at least one accessory mount portion from the rest of the first protective layer.

2. The helmet according to claim 1, wherein the accessory mount portion comprises an accessory mount base for receiving the accessory mount or an accessory.

3. The helmet according to claim 1, wherein the accessory mount portion comprises an inner surface and an outer surface, wherein the inner surface faces an inside volume of the helmet and the outer surface facing outer side of the helmet, wherein the outer surface faces an opposite direction with respect to the inner surface, and wherein the outer surface is larger than the inner surface.

4. The helmet according to claim 1, comprising at least one protective element arranged substantially in a corresponding position relative to the at least one accessory mount portion for preventing the at least one accessory mount portion from penetrating through the helmet.

5. The helmet according to claim 4, comprising a volume between the at least one accessory mount portion and the corresponding protective element to provide space for the at least one accessory mount portion to move in response to the mechanical impact to the at least one accessory mount portion.

6. The helmet according to claim 1, wherein the at least one accessory mount portion consists of material withstanding without breaking a lower mechanical impact to the at least one accessory mount portion with respect to the material of the first protective layer.

7. The helmet according to claim 1, wherein the at least one weakening portion consists of material withstanding without breaking a lower mechanical impact to the at least one accessory mount portion with respect to the material of the first protective layer.

8. The helmet according to claim 1, wherein the at least one weakening portion is arranged around the at least one accessory mount portion defining a portion of the first protective layer with an unsymmetrical shape for disintegrateing the at least one accessory mount portion in response to a lower mechanical impact from a first direction with respect to a mechanical impact from a second direction perpendicular to the first direction.

9. A method for manufacturing a helmet comprising:

obtaining a first protective layer, and arranging at least one accessory mount portion integrally to the first protective layer by molding, such as by injection plastic molding, at least one weakening portion to the first protective layer, wherein the weakening portion is configured to disintegrate the at least one accessory mount portion from the rest of the first protective layer in response to a mechanical impact to the at least one accessory mount portion, and wherein the at least one weakening portion comprises one of the following:

a groove configured to break in response to the mechanical impact to the at least one accessory mount portion for disintegrating the at least one accessory mount portion from the rest of the first protective layer, or a perforation configured to break in response to the mechanical impact to the at least one accessory mount portion for disintegrating the at least one accessory mount portion from the rest of the first protective layer, or a plurality of holes, at least one of the plurality of holes having a depth in the direction of the thickness of the first protective layer less than the thickness of the first protective layer, the plurality of holes configured to break in response to the mechanical impact to the at least one accessory mount portion for disintegrating the at least one accessory mount portion from the rest of the first protective layer.

10. A helmet comprising a first protective layer, the first protective layer comprising at least one accessory mount portion for receiving an accessory mount, the at least one accessory mount portion being arranged integrally as a part of the first protective layer and configured to disintegrate from the rest of the first protective layer in response to a mechanical impact to the at least one accessory mount portion, wherein the accessory mount portion comprises an inner surface and an outer surface, wherein the inner surface faces an inside volume of the helmet and the outer surface facing outer side of the helmet, wherein the outer surface faces an opposite direction with respect to the inner surface, and wherein the outer surface is larger than the inner surface.

11. A helmet comprising a first protective layer, the first protective layer comprising at least one accessory mount portion for receiving an accessory mount, the at least one accessory mount portion being arranged integrally as a part of the first protective layer and configured to disintegrate from the rest of the first protective layer in response to a mechanical impact to the at least one accessory mount portion, wherein the helmet comprises at least one protective element arranged substantially in a corresponding position relative to the at least one accessory mount portion for preventing the at least one accessory mount portion from penetrating through the helmet, and a volume between the at least one accessory mount portion and the corresponding protective element to provide space for the at least one accessory mount portion to move in response to the mechanical impact to the at least one accessory mount portion.

12. A helmet comprising a first protective layer, the first protective layer comprising at least one accessory mount portion for receiving an accessory mount, the at least one accessory mount portion being arranged integrally as a part of the first protective layer and configured to disintegrate from the rest of the first protective layer in response to a mechanical impact to the at least one accessory mount portion, wherein the first protective layer comprises at least one weakening portion configured to break in response to the mechanical impact to the at least one accessory mount portion for disintegrating the at least one accessory mount portion from the rest of the first protective layer, and wherein the at least one weakening portion is arranged around the at least one accessory mount portion defining a portion of the first protective layer with an un symmetrical shape for disintegrating the at least one accessory mount portion in response to a lower mechanical impact from a first direction with respect to a mechanical impact from a second direction perpendicular to the first direction.

* * * * *